US007494027B2

(12) United States Patent
O'Leary et al.

(10) Patent No.: US 7,494,027 B2
(45) Date of Patent: Feb. 24, 2009

(54) DISPENSER PACKAGE

(75) Inventors: Timothy J. O'Leary, White Bear Lake, MN (US); Scott A. Willard, Minneapolis, MN (US); James R. Emmerling, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 208 days.

(21) Appl. No.: 11/341,293

(22) Filed: Jan. 27, 2006

(65) Prior Publication Data

US 2007/0175913 A1 Aug. 2, 2007

(51) Int. Cl.
*B65H 1/00* (2006.01)

(52) U.S. Cl. ..... 221/34; 221/44; 221/45

(58) Field of Classification Search ..... 221/34, 221/44, 45

See application file for complete search history.

(56) References Cited

U.S. PATENT DOCUMENTS

| | | | | |
|---|---|---|---|---|
| 3,691,140 | A | 9/1972 | Silver | |
| 3,857,731 | A | 12/1974 | Merrill, Jr. et al. | |
| 4,166,152 | A | 8/1979 | Baker et al. | |
| 4,416,392 | A | 11/1983 | Smith | |
| 4,770,320 | A | 9/1988 | Miles et al. | |
| 4,781,306 | A | 11/1988 | Smith | |
| 4,907,825 | A | 3/1990 | Miles et al. | |
| 4,993,590 | A | 2/1991 | Windorski | |
| 5,158,205 | A | 10/1992 | Bodziak et al. | |
| 5,551,595 | A * | 9/1996 | Mertens et al. | 221/45 |
| 5,571,617 | A | 11/1996 | Cooprider et al. | |
| 5,663,241 | A | 9/1997 | Takamatsu et al. | |
| 5,714,237 | A | 2/1998 | Cooprider et al. | |
| 5,755,337 | A * | 5/1998 | Linn | 211/13.1 |
| 5,755,356 | A | 5/1998 | Bastiaens et al. | |
| 5,756,625 | A | 5/1998 | Crandall et al. | |
| 5,769,270 | A * | 6/1998 | Fujisawa et al. | 221/34 |
| 5,824,748 | A | 10/1998 | Kesti et al. | |
| RE37,563 | E | 2/2002 | Cooprider et al. | |
| 6,514,585 | B1 * | 2/2003 | Pearson et al. | 221/33 |
| 6,681,452 | B1 * | 1/2004 | Holland | 221/33 |
| D508,955 | S * | 8/2005 | Jour | D19/86 |

FOREIGN PATENT DOCUMENTS

| | | |
|---|---|---|
| WO | WO 96/36493 | 11/1996 |

* cited by examiner

*Primary Examiner*—Gene Crawford
*Assistant Examiner*—Timothy R Waggoner
(74) *Attorney, Agent, or Firm*—Robert H. Jordan

(57) ABSTRACT

A dispenser package for dispensing flexible sheets from a plurality of stacks of releasably adhered sheets. A carrier member supports the plurality of stacks, and a lowermost sheet of each of the plurality of stacks is adhered to the carrier member. The carrier member and stacks thereon are positioned within an enclosure having a bottom wall, a top wall, and transverse side walls. The top wall defines a transverse slot, with a first end of an uppermost sheet of each of the plurality of stacks projecting through the slot. The transverse side walls of the enclosure are spaced from transverse side edges of the carrier member to afford end-to-end movement of the carrier member and stacks of sheets thereon within the chamber as sheets are dispensed.

19 Claims, 4 Drawing Sheets

DISPENSER PACKAGE

BACKGROUND

The present invention relates to dispensers for supplying sheets of material, such as tape flags and/or paper notes, from coherent stacks of such sheets. The invention is particularly related to such dispensers that hold and supply sheets from a plurality of stacks of flexible sheets.

The art is replete with dispensers for supplying sheets of material that are adapted to mark portions of substrates such as written documents. Sheets from Post-it® brand flag and note pads available from 3M Company are used extensively as such sheets, and are particularly useful for that purpose because a repositionable pressure sensitive adhesive with which they are coated allows them to be placed on and removed from a document without damage to the document. A wide variety of such sheets are available to suit various needs and purposes of the user. For example, in addition to having different sizes and colors, some sheets are made of paper, while other sheets are made of a polymeric material; some sheets are opaque, so as to allow the user to write a message on the sheet, while other sheets are substantially transparent to allow easy viewing of the document to which the sheet is attached; and some sheets have a large percentage of the surface coated with adhesive, while other sheets have only a small percentage of the surface coated with adhesive.

The variety of such sheets has resulted in a similar variety of dispensers, because the dispensing characteristics of the sheets also vary with, for example, sheet size or shape, type of sheet material, amount and location of adhesive on the sheet, and so on. The dispensers are typically optimized for dispensing a particular type of sheet (for example, polymeric sheets having a majority of one surface coated with adhesive, or paper sheets having only a narrow strip of adhesive on one surface). Dispensers tend to be either (1) of the type in which the bottom sheet of the stack of sheets is attached to the bottom of the housing or the stack is otherwise restricted from significant movement in the housing, and the sheets are dispensed through a fairly wide slot as is taught in U.S. Pat. No. 5,769,270 Fujisawa et al., or (2) of the type in which the stack of sheets is free to reciprocate or shuttle in the housing as the sheets are dispensed, and the sheets are dispensed through a rather narrow slot as is taught in U.S. Pat. No. 4,907,825 to Miles et al.

A user may desire or have need to use sheets of more than one type (e.g., sheets of different colors, sizes, and/or materials). Accordingly, dispensers for use with multiple stacks of sheets are known. However, presently available multi-stack dispensers have deficiencies. For example, multi-stack dispensers using a "shuttling" action to dispense individual sheets are segmented into multiple slots or compartments with each slot or compartment containing a single stack of sheets to allow independent movement and maintain lateral spacing of the stacks. Such dispensers are complex to form and do not lend themselves well to automated assembly. In addition, multi-stack dispensers are typically designed for stacks having sheets with a common construction (e.g., the same sheet material, amounts of adhesive, sizes, etc.) and use the same method of dispensing (e.g., shuttling movement or restricted movement), and are not suitable for use with stacks having sheets with different constructions or requiring different methods of dispensing.

SUMMARY

One aspect of the invention described herein provides a dispenser package for dispensing flexible sheets. In one embodiment according to the invention, the dispenser package comprises a plurality of stacks of flexible sheets. The sheets of each stack comprise a layer of material having opposite top and bottom major side surfaces and first and second opposite ends. Each sheet has a coating of pressure sensitive adhesive on a second end portion of one of the side surfaces adjacent the second end while being free of adhesive on both of the side surfaces on a first end portion thereof adjacent the first end. The sheets are releasably adhered to each other by adhesion of the coatings of pressure sensitive adhesive to form the stack with adjacent ends of the sheets aligned and with the first and second ends of successive sheets in the stack being adjacent. A carrier member supports the plurality of stacks of flexible sheets, wherein a lowermost sheet of each of the plurality of stacks is adhered to the carrier member to restrict movement of each stack relative to the carrier member. The carrier member has transverse side edges substantially parallel to the first and second ends of the sheets. An enclosure comprising walls defines a chamber in which the carrier member and stacks of sheets thereon are positioned. The enclosure walls comprise a bottom wall defining a bottom side of the chamber, a top wall defining a top side of the chamber, and transverse side walls substantially parallel to the first and second ends of the sheets and extending between the top wall and the bottom wall. The top wall has a portion defining a generally central transverse slot substantially parallel to the first and second ends of the sheets, the top wall positioned adjacent an uppermost sheet of each of the plurality of stacks with the first end of the uppermost sheet of each stack projecting through the slot. The transverse side walls of the enclosure are spaced from the transverse side edges of the carrier member and the first and second ends of the sheets to afford end-to-end movement of the carrier member and stacks of sheets thereon within the chamber.

In another embodiment according to the invention, the dispenser package comprises a plurality of stacks of flexible sheets. The sheets of each stack comprise a layer of material having opposite top and bottom major side surfaces and first and second opposite ends. Each sheet has a coating of pressure sensitive adhesive on a second end portion of one of the side surfaces adjacent the second end while being free of adhesive on both of the side surfaces on a first end portion thereof adjacent the first end. The sheets are releasably adhered to each other by adhesion of the coatings of pressure sensitive adhesive to form the stack with adjacent ends of the sheets aligned and with the first and second ends of successive sheets in the stack being adjacent. A carrier member supports the plurality of stacks of flexible sheets, wherein a lowermost sheet of each of the plurality of stacks is adhered to the carrier member to restrict movement of each stack relative to the carrier member. The carrier member has transverse side edges substantially parallel to the first and second ends of the sheets, wherein a distance between the transverse side edges of the carrier member is at least as large as a distance between the first and second ends of the sheets of all of the plurality of stacks. An enclosure comprising walls defines a chamber in which the carrier member and stacks of sheets thereon are positioned. The enclosure walls comprise a bottom wall defining a bottom side of the chamber, a top wall defining a top side of the chamber, and transverse side walls substantially parallel to the first and second ends of the sheets and extending between the top wall and the bottom wall. The top wall defines a transverse slot substantially parallel to the first and second ends of the sheets, the top wall positioned adjacent an uppermost sheet of each of the plurality of stacks with the first end of the uppermost sheet of each stack projecting through the slot. The transverse side walls of the enclosure are spaced from the transverse side edges of the carrier member such that a distance between the transverse side edges of the carrier member is in the range of 88 to 98 percent of a distance between the transverse side walls of the enclosure. As a selected uppermost sheet of one of the plurality of stacks is pulled through the slot, the carrier member and stacks of sheets thereon all move from an initial position to a final position as the first end of an underlying sheet adhered to the selected sheet is pulled through the slot and projects through the slot after the selected uppermost sheet is fully peeled from the underlying sheet.

BRIEF DESCRIPTION OF THE DRAWINGS

The present invention will be further described with reference to the accompanying drawings wherein like reference numerals refer to like parts in the several views, and wherein.

DETAILED DESCRIPTION

In the following Detailed Description, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1A:
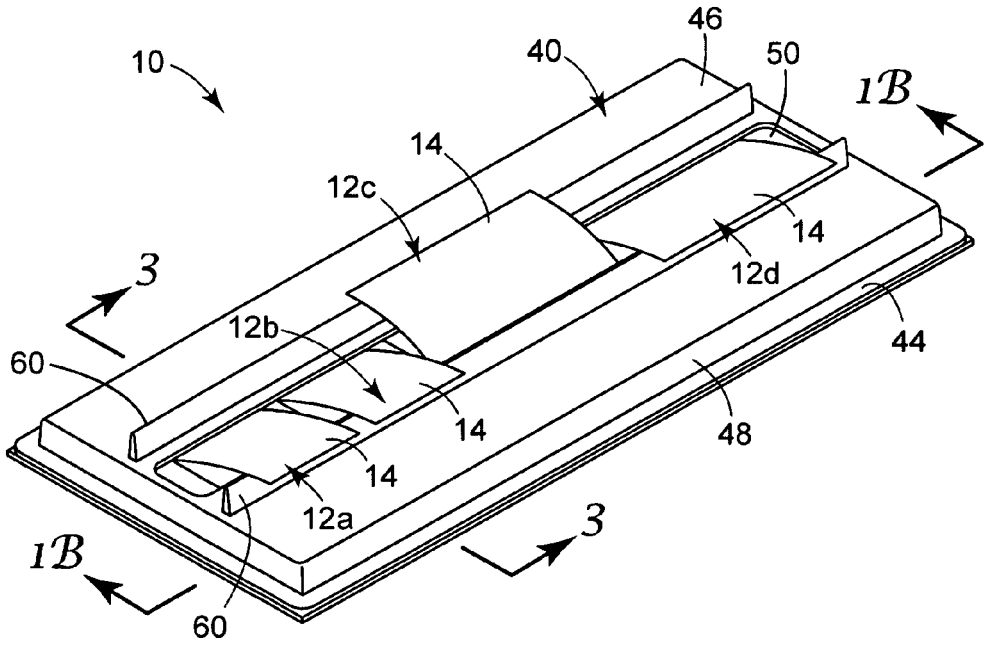
FIG. 1A is a perspective illustration of one embodiment of a dispenser container according to the invention.
Figure 1B:
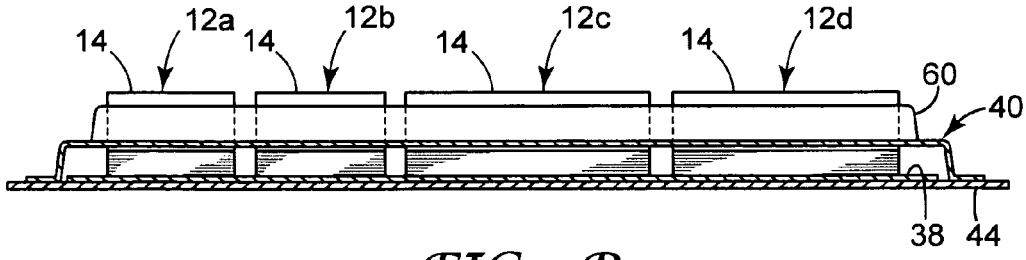
FIG. 1B is an enlarged sectional illustration of the dispenser container of FIG. 1A, taken along line 1B-1B, in which a plurality of stacks of sheets are shown adhered to a common carrier member

Referring now to FIGS. 1A-7, there is shown a first embodiment of a dispenser package according to the present invention generally designated by the reference numeral 10. The dispenser package 10 includes a plurality of stacks 12*a*, 12*b*, 12*c*, 12*d* (generally referred to herein as stacks 12) of flexible sheets 14. In FIGS. 1A and 1B, four stacks 12 are illustrated, although other embodiments of the dispenser package 10 may comprise more or less than the illustrated four stacks 12. In one embodiment, the stacks 12 comprise sheets 14 having substantially similar construction (i.e., the construction of sheets 14 of stack 12*a* is substantially similar to the sheets 14 of stacks 12*b*, 12*c*, and 12*d*). For example, the sheets 14 of each of the stacks 12 are formed of the same material, have substantially the same proportion of adhesive coverage, are of the same size (e.g., end-to-end length), and vary only in color. In another embodiment, the stacks 12 comprise sheets 14 having substantially different construction (i.e., the construction of sheets 14 of stack 12*a* is substantially different from the sheets 14 of stacks 12*b*, 12*c*, and 12*d*). For example, the sheets 14 of stack 12*a* are formed of a different material and/or have a different size than the sheets of stacks 12*b*, 12*c*, and 12*d*.

Figure 2A:
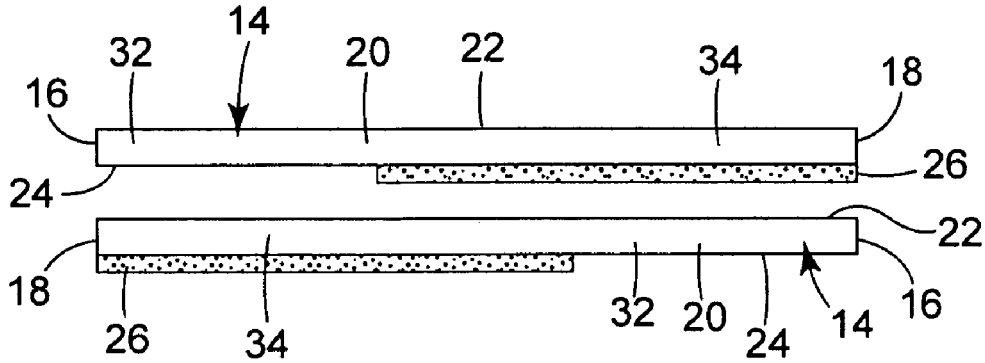
FIGS. 2A and 2B are sectional illustrations of embodiments of sheets suitable for use with the dispenser container of FIG. 1A.
Figure 2B:
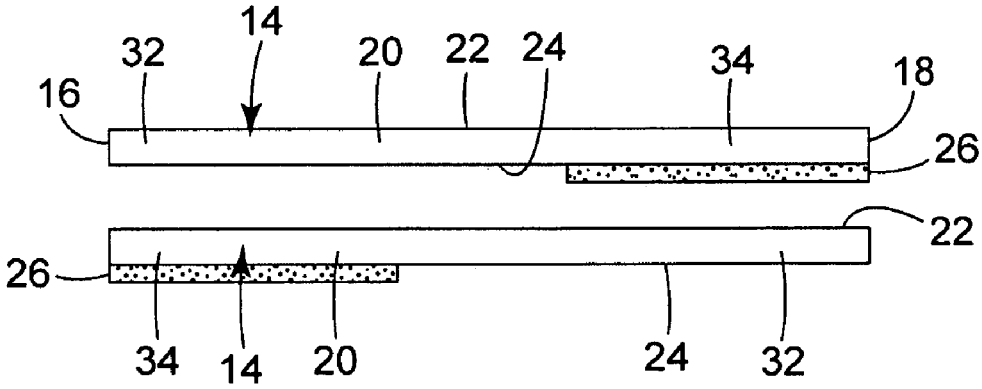
Figure 3:
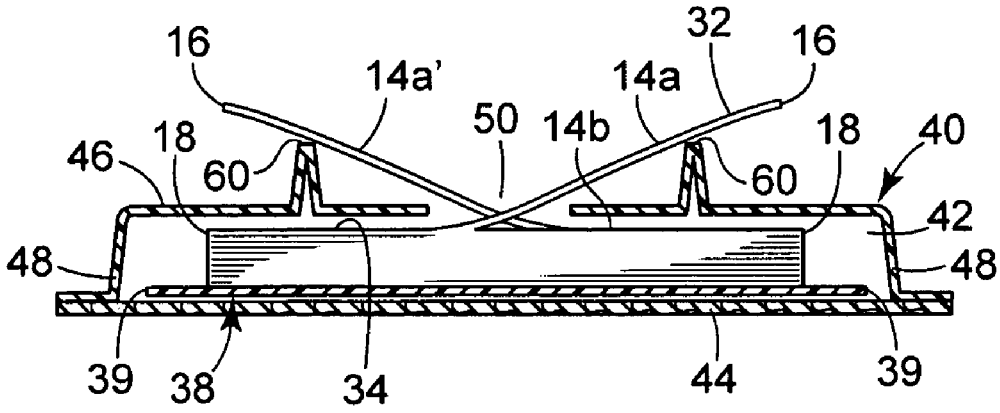
FIGS. 3-6 are enlarged sectional illustrations of the dispenser container of FIG. 1A, taken along line 3-3, in which the thickness of the sheets is greatly exaggerated to show detail and which sequentially illustrate a sheet being pulled from one of the plurality of stacks in the dispenser container.
Figure 4:
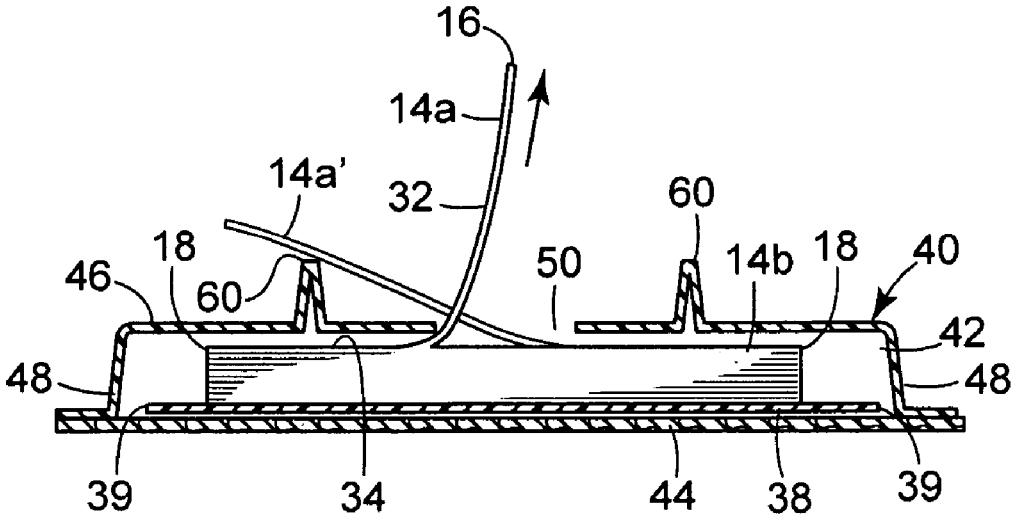
Figure 5:
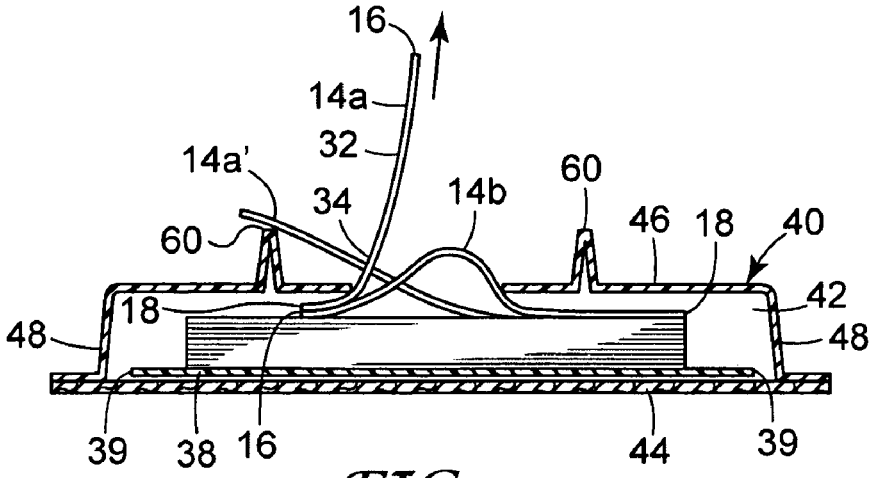
Figure 6:
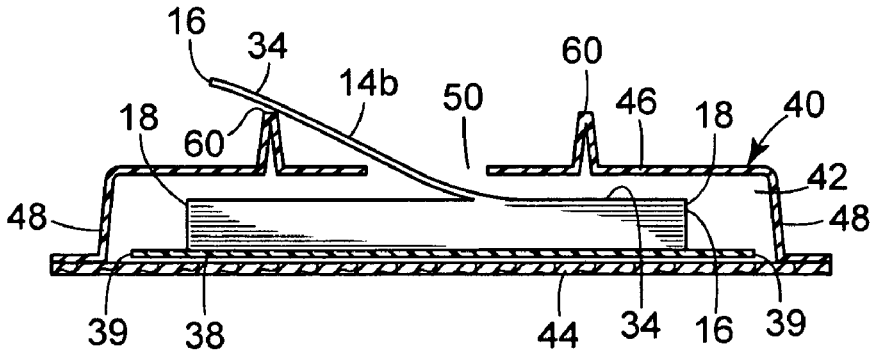

FIGS. 2A and 2B illustrate exemplary embodiments of the sheets 14 that may be used to form the stacks 12, where like elements are similarly numbered. In FIGS. 2A and 2B, only two of the sheets 14 from the stack 12 are shown, and the sheets 14 are aligned with respect to each other as they are in the stack 12 but slightly separated for clarity concerning the portions of the sheets 14. Each of the sheets 14 comprises a rectangular member having first and second opposite ends 16 and 18 and a predetermined length between its first and second ends 16 and 18, and comprises a backing 20 having opposite major top and bottom side surfaces 22 and 24. The backing 20 comprises any suitable material, including paper and polymeric materials. In one embodiment, backing 20 comprises a substantially transparent flexible polymeric material such as polyester. In one embodiment, backing 20 is a 2.4 mil thick polyester. A layer of pressure sensitive adhesive 26 is on bottom surface 24 of backing 20. The sheets 14 are releasably adhered to each other by releasable adhesion of the layers of pressure sensitive adhesive 26 to the top surfaces 22 of underlying sheets 14 to form the stack 12 with adjacent ends 16 or 18 of the sheets 14 aligned and with the first and second ends 16 and 18 of successive sheets 14 in the stack 12 being adjacent.

Various repositionable adhesives can be used. Suitable repositionable adhesives are disclosed in U.S. Pat. No. 3,691,140 (Silver); U.S. Pat. No. 3,857,731 (Merrill et al.); U.S. Pat. No. 4,166,152 (Baker et al.); U.S. Pat. No. 4,495,318 (Howard); U.S. Pat. No. 5,045,569 (Delgado); U.S. Pat. No. 5,073,457 (Blackwell) and U.S. Pat. No. 5,571,617 (Cooprider et al.), U.S. Pat. No. 5,663,241 (Takamatsu et al.); U.S. Pat. No. 5,714,237 (Cooprider et al.); U.S. RE 37,563 (Cooprider et al.); and U.S. Pat. No. 5,756,625 (Crandall et al.) and U.S. Pat. No. 5,824,748 (Kesti et al.). The repositionable adhesive can be solvent based, or water based.

Referring to the exemplary sheet embodiment of FIG. 2A, each of the sheets 14 includes a layer 26 of pressure sensitive adhesive on at least a second end portion 34 of the bottom surface 24 adjacent the second end 18 of the backing 20. The sheets 14 in the stack 12 are releasably adhered to each other by adhesion of the layers of pressure sensitive adhesive 26 to portions of the top surfaces of underlying sheets 14 adjacent the first ends 16 of the underlying sheets 14 to form the stack 12 with adjacent ends 16 and 18 of the sheets 14 aligned and with the first and second ends 16 and 18 of successive sheets 14 in the stack 12 being adjacent. In the illustrated embodiment, the second end portion 34 has a length from the second end 18 of the backing 20 toward its first end 16 that is longer than half the predetermined length of the backing 20. In FIG. 2B, the second end portion 34 has a length from the second end 18 of the backing 20 toward its first end 16 that is shorter than half the predetermined length of the backing 20.

In the sheets 14 illustrated in FIGS. 2A-2B, the pressure sensitive adhesive in the layers 26 is repositionable, and the first end portions 32 of the sheets 14 are configured to prevent or reduce adhesion of the first end portions 32 of the sheets 14 adjacent their first ends 16 to an underlying sheet 14. In some embodiments, the first end portion 32 is smaller in area than the second end portion 34, while in other embodiments the first end portion 32 is larger in area than the second end portion 34. In some embodiments, the first end portion 32 is printed with a bright colored ink (e.g., red, green or yellow) to make it visually distinctive; while the adhesive coated second end portion 34 is generally transparent when adhered to a substrate so that it will not obscure a substrate to which it is attached. Also, preferably the top side surface 22 opposite the coating adhesive 26 is adapted to be written on by methods known in the art.

Figure 7:
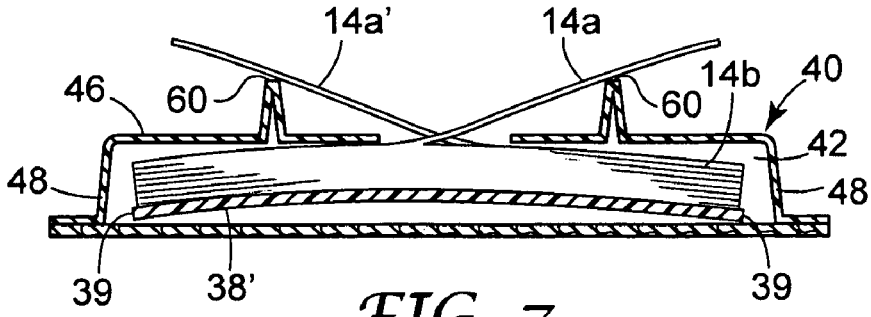
FIG. 7 is an enlarged sectional illustration of the dispenser container of FIG. 1A, showing an alternate embodiment for the carrier member.

Referring now to FIGS. 3-6, the stacks 12 of sheets 14 are each supported on a single or common carrier member 38. A lowermost sheet 14 of each stack 12 is adhered or otherwise fixed along its full length to carrier member 38 to restrict endwise movement of the stacks 12 relative to the carrier member 38, and to restrict flexing of the second end portions 34 of all but the uppermost sheet 14 in the stack 12 around an axis parallel to the ends 16, 18 of the sheets 14 in the stack 12. The carrier member includes transverse side edges 39 substantially parallel to the first and second ends 16, 18 of the sheets 14. The distance between the transverse side edges 39 of the carrier member 38 is equal to or greater than the distance between the first and second ends 16, 18 of the sheets 14 of at least one of the plurality of stacks 12. In one embodiment, the carrier member 38 is substantially flat. In another embodiment, the carrier member 38 is configured to bias or urge the stacks 12 toward top wall 46. For example, as best seen in FIG. 7, a carrier member 38' may be formed from a resilient material and provided with an arcuate cross-sectional shape that is initially deflected toward bottom wall 44 when dispenser package 10 is new, and that resumes its arcuate shape as sheets 14 are dispensed from stacks 12.

As noted above, the stacks 12 secured to carrier member 38 may comprise sheets 14 having substantially similar construction, or may comprise sheets 14 having substantially different construction. In one embodiment, the sheets 14 of one of the plurality of stacks 12 are formed from a polymeric material, and the sheets 14 of another one of the plurality of stacks 12 are formed from paper. In one embodiment, the sheets 14 of one of the plurality of stacks 12 have a first size, and the sheets 14 of another one of the plurality of stacks 12 have a second size different from the first size. In one embodiment, the sheets 14 having a first size have an end-to-end distance (i.e., from first end 16 to second end 18) greater than an end-to-end distance of the sheets 14 having a second size. In one embodiment, the sheets 14 having a first size have a transverse width (i.e., parallel to first and second ends 16, 18) greater than a transverse width of the sheets 14 having a second size. In yet another embodiment, the reduced adhesion or adhesive-free first end portions 32 of the sheets 14 of one of the plurality of stacks 12 are smaller in area than the adhesive-coated second end portions 34, and the reduced adhesion or adhesive-free first end portions 32 of the sheets 14 of another one of the plurality of stacks 12 are larger in area than the adhesive-coated second end portions 34.

Referring now to FIGS. 1A, 1B, and 3-6, the dispenser package 10 also includes an enclosure 40 comprising walls defining a chamber 42 in which the carrier member 38 with stacks 12 secured thereto is positioned. Those walls include a bottom wall 44, a top wall 46 opposite the bottom wall 44, and transverse upstanding side walls 48 extending between the bottom walls 44 and top wall 46. The top wall 46 defines a top side of the chamber 42, and further defines a generally central transverse slot 50 substantially parallel to the first and second ends 16, 18 of the sheets 14. The top wall 46 is positioned adjacent an uppermost sheet 14 of each of the plurality of stacks 12 (which uppermost sheet is identified as **14*a* in FIGS. 3 through 7), with the first end 16 of the uppermost sheet 14*a* of each stack 12 projecting through the slot 50. In FIGS. 3-7, an uppermost sheet 14*a*' of a second stack 12 is also illustrated. In one embodiment, the top wall 46 and side walls 48 comprise molded plastic, while bottom wall 44** comprises a paper or cardstock material to which the molded plastic top and side walls are secured, as by an adhesive.

The transverse side walls 48 are substantially parallel to the first and second ends 16, 18 of the sheets 14, and are spaced from the transverse side edges of the carrier member 38 and the first and second ends 16, 18 of the sheets 14 to afford limited end-to-end movement (e.g. shuttling) of the carrier member 38 and stacks 12 of sheets 14 thereon within the chamber 42 and thus provide relative movement between the slot 50 and the uppermost sheets **14*a*. Thus, when the uppermost sheet 14*a* of one of the plurality of stacks 12 is dispensed (as described in greater detail below), the carrier member 38 and all of the stacks 12 secured thereto undergo end-to-end movement. In one embodiment, the carrier member 38 and side walls 48 are sized and positioned such that the distance between the transverse side edges 39 of the carrier member 38 is in the range of 88 to 98 percent of the distance between the transverse side walls 48 of the enclosure 40. In one embodiment, carrier member 38 and chamber 42 are also dimensioned to afford limited movement of carrier member 38 in a direction parallel to transverse side edges 39 (and first and second ends 16, 18 of sheets 14), such that carrier member 38 and stacks 12 thereon move or "float" within chamber 42** in three dimensions.

The relative movement between the portion of the top wall 46 defining the slot 50 and the uppermost sheet **14*a* from an initial carrier member 38 position (FIG. 3) to a final carrier member 38 position (FIGS. 4-5) affords, as the uppermost sheet 14*a* is manually pulled through the slot 50, alignment of the slot 50 with successive portions of the uppermost sheet 14*a* toward the second end 18 of the uppermost sheet 14*a* as the successive portions are peeled from an underlying sheet 14 in the stack 34 (identified as 14*b* in FIGS. 3 through 7) to which the uppermost sheet 14*a* is adhered. In the final position (FIGS. 4-5) the slot 50 is located to afford transverse folding of the underlying sheet 14*b* (FIG. 5) at about the juncture between the first and second portions 32 and 34, and movement of the first end portion 32 of the underlying sheet 14*b* through the slot 50 with the second end portion 34 of the uppermost sheet 14*a* to leave, after the uppermost sheet 14*a* is fully peeled from the underlying sheet 14*b*, the first end portion 32 of the underlying sheet 14*b* in a position projecting through the slot 50 in the top wall 46 (FIG. 6) and the underlying sheet 14*b* and the portion of the top wall 46 defining the slot 50 in the initial relative position with respect to each other. As can be seen in the Figures, the slot 50 is substantially centrally positioned between the first and second ends 16, 18 of the sheets 14 in both the initial and final carrier member 38 positions. In one embodiment, the slot 50 is dimensioned such that at least a portion of the slot 50 is positioned over a mid-point between the first and second ends 16, 18 of the sheets 14 in both the initial and final carrier member 38** positions.

The uppermost sheet **14*a* on each of the plurality of stacks 12 is resiliently bent so that first ends 16 and first end portions 32 project through the slot 50 and rest against an abutment surface 60 on top wall 46 adjacent opposing sides of slot 50. The abutment surfaces 60 insure the first end portions 32 of the sheets 14***a* projecting through the slot 50 are spaced from the top wall 46, so that the first end portion 32 may be easily grasped by a user. In one embodiment, because of the relationship between the abutment surfaces 60 and the position of the adhesive 26, release coatings 28, 30, and/or tabs 37 as described with respect to FIGS. 2A-2B, the first end portions 32 of the uppermost sheets 14 are disposed at an angle with respect to the second end portion 34 of the uppermost sheet 14 that is adhered to the first underlying sheet 14 in the stack 12, such that a user may easily grasp the first end portion 32 of a desired sheet 14*a*. The width of slot 50 is selected to help prevent a phenomenon in which more than one sheet 14 is pulled through the slot 50 by the uppermost sheet 14*a* being removed which may occur if contact occurs between folded first portion 32 and adhesive coated second portion 34 of the underlying sheet 14*b* as the underlying sheet 14*b* is pulled from the dispenser package 10 by the uppermost sheet 14*a*, and which phenomenon is exacerbated when that uppermost sheet 14*a* is pulled in a direction generally parallel to the top wall 46 rather than at a right angle thereto. In one embodiment, abutment surfaces 60 are at least about 0.5 centimeter (0.2 inch) long in a direction normal to the top surface of the top wall 46 and spaced about 1.5 to 2.0 centimeters (0.6 to 0.8 inches).

In one exemplary embodiment, the dispenser package 10 comprises four stacks 12 of sheets 14. The stacks 12 have dimensions of approximately 1.5 inches by 2 inches (3.8 cm by 5.1 cm), 1.5 inches by 1 inch (3.8 cm by 2.5 cm), 1.5 inches by 0.5 inches (3.8 cm by 1.3 cm), and 1.5 inches by 0.5 inches (3.8 cm by 1.3 cm) and are each of a different color. The stacks 12 are attached to a carrier member 38 made from 22 mil PET film having dimensions of approximately 2.01 inches by 4.66 inches (5.1 cm by 11.8 cm). The stacks 12 are separated from each other on the carrier member 12 by a distance of approximately 0.02 inches (0.5 mm). The transverse side walls 48 of the enclosure 40 are spaced apart by a distance of approximately 2.17 inches (5.5 cm), such that the carrier member 38 width of 2.01 inches (5.1 cm) is approximately 93% of the distance between side walls 48. Slot 50 is centrally positioned between side walls 48 and has a width of approximately 0.375 inches (0.95 cm).

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A dispenser package comprising:

a plurality of stacks of flexible sheets, the sheets of each stack comprising a layer of material having opposite top and bottom major side surfaces and first and second opposite ends, each sheet having a coating of pressure sensitive adhesive on a second end portion of one of the side surfaces adjacent the second end while being free of adhesive on both of the side surfaces on a first end portion thereof adjacent the first end, the sheets being releasably adhered to each other by adhesion of the coatings of pressure sensitive adhesive to form the stack with adjacent ends of the sheets aligned and with the first and second ends of successive sheets in the stack being adjacent;

a carrier member supporting the plurality of stacks of flexible sheets, wherein a lowermost sheet of each of the plurality of stacks is adhered to the carrier member to restrict movement of each stack relative to the carrier member, the carrier member having transverse side edges substantially parallel to the first and second ends of the sheets; and an enclosure comprising walls defining a chamber in which the carrier member and stacks of sheets thereon are positioned, the walls comprising:

a top wall defining a top side of the chamber, the top wall having a portion defining a generally central transverse slot substantially parallel to the first and second ends of the sheets, the top wall positioned adjacent an uppermost sheet of each of the plurality of stacks with the first end of the uppermost sheet of each stack projecting through the slot;

a bottom wall defining a bottom side of the chamber; and transverse side walls substantially parallel to the first and second ends of the sheets and extending between the top wall and the bottom wall;

wherein the transverse side walls of the enclosure are spaced from the transverse side edges of the carrier member and the first and second ends of the sheets to afford end-to-end movement of the carrier member and stacks of sheets thereon within the chamber.

2. The package according to claim 1, wherein the end-to-end movement provides relative movement between the slot and all of the uppermost sheets of the plurality of stacks from initial to final relative positions, such that as the uppermost sheet of a selected one of the plurality of stacks is pulled through the slot successive portions of the uppermost sheet toward the second end are aligned with the slot as the successive portions are peeled from an underlying sheet in the stack to which the uppermost sheet is adhered, in the final position the slot being located to afford folding of the underlying sheet and movement through the slot of the first end of the underlying sheet, with the second end portion of the uppermost sheet of the selected stack to leave the first end of the underlying sheet projecting through the slot after the uppermost sheet is fully peeled from the underlying sheet.

3. The package according to claim 1, wherein the sheets of at least one of the plurality of stacks are formed from a polymeric material, first end portions of the sheets are printed with a colored ink, and the adhesive coated second end portions are generally transparent when adhered to a substrate.

4. The package according to claim 1, wherein the sheets of at least one of the plurality of stacks are formed from paper.

5. The package according to claim 1, wherein the sheets of a first one of the plurality of stacks are formed from a polymeric material, and wherein the sheets of a second one of the plurality of stacks are formed from paper.

6. The package according to claim 1, wherein the adhesive-free first end portions of the sheets of a first one of the plurality of stacks are smaller in area than the adhesive-coated second end portions, and wherein the adhesive-free first end portions of the sheets of a second one of the plurality of stacks are larger in area than the adhesive-coated second end portions.

7. The package according to claim 1, wherein the carrier member is configured to bias the uppermost sheets of each of the plurality of stacks against the top wall.

8. The package according to claim 1, wherein a distance between the transverse side edges of the carrier member is in the range of 88 to 98 percent of a distance between the transverse side walls of the enclosure.

9. The package according to claim 1, wherein a distance between the transverse side edges of the carrier member is greater than a distance between the first and second ends of the sheets of at least one of the plurality of stacks.

10. The package according to claim 1, wherein the plurality of stacks of flexible sheets comprise:

a first stack having sheets of a first size; and a second stack having sheets of a second size.

11. The package according to claim 10, wherein the sheets of a first size have an end-to-end distance greater than an end-to-end distance of sheets of the second size.

12. The package according to claim 10, wherein the sheets of a first size have a transverse width greater than a transverse width of sheets of the second size.

13. The package according to claim 1, wherein the pressure sensitive adhesive is repositionable.

14. A dispenser package comprising:

a plurality of stacks of flexible sheets, the sheets of each stack comprising a layer of material having opposite top and bottom major side surfaces and first and second opposite ends, each sheet having a coating of pressure sensitive adhesive on a second end portion of one of the side surfaces adjacent the second end while being free of adhesive on both of the side surfaces on a first end portion thereof adjacent the first end, the sheets being releasably adhered to each other by adhesion of the coatings of pressure sensitive adhesive to form the stack with adjacent ends of the sheets aligned and with the first and second ends of successive sheets in the stack being adjacent;

a carrier member supporting the plurality of stacks of flexible sheets, wherein a lowermost sheet of each of the plurality of stacks is adhered to the carrier member to restrict movement of each stack relative to the carrier member, the carrier member having transverse side edges substantially parallel to the first and second ends of the sheets, wherein a distance between the transverse side edges of the carrier member is at least as large as a distance between the first and second ends of the sheets of all of the plurality of stacks; and an enclosure comprising walls defining a chamber in which the carrier member and stacks of sheets thereon are positioned, the walls comprising:

a top wall defining a top side of the chamber, the top wall defining a transverse slot substantially parallel to the first and second ends of the sheets, the top wall positioned adjacent an uppermost sheet of each of the plurality of stacks with the first end of the uppermost sheet of each stack projecting through the slot;

a bottom wall defining a bottom side of the chamber; and transverse side walls substantially parallel to the first and second ends of the sheets and extending between the top wall and the bottom wall, the transverse side walls of the enclosure spaced from the transverse side edges of the carrier member such that a distance between the transverse side edges of the carrier member is in the range of 88 to 98 percent of a distance between the transverse side walls of the enclosure;

wherein as a selected uppermost sheet of one of the plurality of stacks is pulled through the slot, the carrier member and stacks of sheets thereon all move from an initial position to a final position as the first end of an underlying sheet adhered to the selected sheet is pulled through the slot and projects through the slot after the selected uppermost sheet is fully peeled from the underlying sheet.

15. The package according to claim 14, wherein the slot is substantially centrally positioned between the first and second ends of the sheets in both the initial and final carrier member positions.

16. The package according to claim 15, wherein the slot is dimensioned such that at least a portion of the slot is positioned over a mid-point between the first and second ends of the sheets in both the initial and final carrier member positions.

17. The package according to claim 14, wherein the sheets of at least one of the plurality of stacks are formed from a polymeric material, and wherein the sheets of at least another one of the plurality of stacks are formed from paper.

18. The package according to claim 17, wherein the adhesive-free first end portions of the sheets formed from a polymeric material are smaller in area than the adhesive-coated second end portions, and wherein the adhesive-free first end portions of the sheets formed from paper are larger in area than the adhesive-coated second end portions.

19. The package according to claim 14, wherein the carrier member is configured to bias the uppermost sheets of each of the plurality of stacks against the top wall.

* * * * *